US006810540B2

(12) United States Patent
Harrow

(10) Patent No.: US 6,810,540 B2
(45) Date of Patent: Nov. 2, 2004

(54) BED BASE WITH ADJUSTABLE CROSS BAR

(76) Inventor: Lawrence M. Harrow, 5959 Corvette St., Commerce, CA (US) 90040

( * ) Notice: Subject to any disclaimer, the term of this patent is extended or adjusted under 35 U.S.C. 154(b) by 0 days.

(21) Appl. No.: 10/402,190

(22) Filed: Mar. 28, 2003

(65) Prior Publication Data

US 2004/0187208 A1 Sep. 30, 2004

(51) Int. Cl.[7] ..... A47C 19/04
(52) U.S. Cl. ..... 5/184; 5/181; 5/201; 5/202
(58) Field of Search ..... 5/200.1, 201–203, 5/282.1, 285, 2, 181, 184, 286

(56) References Cited

U.S. PATENT DOCUMENTS 3,123,837 A * 3/1964 Paine et al. ..... 5/181
3,952,345 A * 4/1976 Spitz ..... 5/207
4,078,270 A * 3/1978 Nowell ..... 5/181
4,224,704 A * 9/1980 Nowell ..... 5/181
4,276,665 A * 7/1981 Mis ..... 5/184

* cited by examiner

*Primary Examiner*—Teri Pham Luu
(74) *Attorney, Agent, or Firm*—John J. Connors; Connors & Assoc. Inc.

(57) ABSTRACT

A bed base is disclosed that that has an integrated locking and release crossbar mechanism to enable adjustment of the width of the bed base to correspond to the width of the bed mattress and/or box spring.

19 Claims, 3 Drawing Sheets

BED BASE WITH ADJUSTABLE CROSS BAR

INCORPORATION BY REFERENCE

Applicant incorporates herein by reference any and all U.S. patents, U.S. patent applications, and other documents cited or referred to in this application or cited or referred to in the U.S. patents and U.S. patent applications incorporated herein by reference.

The words "comprising," "having," and "including," and other forms thereof, are intended to be equivalent in meaning and be open ended in that an item or items following any one of these words is not meant to be an exhaustive listing of such item or items, or meant to be limited to only the listed item or items.

BACKGROUND OF INVENTION

Bed bases are used to raise mattresses and box springs above a supporting surface. Universal bed bases have adjustable widths that allow the base to support different sizes of mattresses and box springs, including king, queen, full and twin. U.S. Pat. Nos. 5,920,930 and 6,415,465 B1 illustrate typical bed bases.

SUMMARY OF INVENTION

This invention has one or more desirable features discussed subsequently herein. After reading the following section entitled "DETAILED DESCRIPTION OF SOME EMBODIMENTS OF THIS INVENTION," one will understand how the features of this invention provide its benefits. These benefits include, but are not limited to: a bed base including a manually adjustable crossbar that accommodates beds of different sizes, a ratchet mechanism that prevents opposed side rail members from moving in an outward direction away from each other, a locking and release crossbar mechanism for the crossbar, and a return for this locking and release crossbar mechanism that may use a spring or gravity.

Without limiting the scope of this invention as expressed by the claims that follow, some, but not necessarily all, of its features are:

One, bed base includes a pair of opposed side rail members, and a crossbar connected between the side members. Typically, the side members are opposed to each other and parallel and the crossbar is connected substantially at a right angle between the side members. Usually, a pair of crossbars is connected between the side rail members spaced apart and parallel to each other. Each crossbar includes a ratchet mechanism to control the movement of the side rail members relative to each other. The ratchet mechanism has a locked position that prevents the opposed side rail members from moving in an outward direction away from each other and an unlocked position that enables the opposed side rail members to move outward relative to each other.

Two, the crossbar includes a first crossbar member and a second crossbar member connected together so that these crossbar members move relative to each other. The first crossbar member may have a finger element moveable between a first position and a second position and the second crossbar member may have a plurality of teeth. Typically, the teeth are in a series in a row side by side and face inwardly. The finger element in the first position engages one of the teeth to prevent relative movement between the first and second crossbar members and in the second position disengages from the teeth to enable relative movement between the first and second crossbar members.

Three, the finger element may be interactive with a spring member that normally basis this finger element into the first position. Or, the finger element may be mounted to move into the first position due to gravity to engage the teeth and is manually moveable into the second position to disengage from the teeth.

Four, the first crossbar member has a first end attached to one side rail member and may have a second open end, a top side, a second side, and a third side. There may be an opening in the first crossbar member. This opening is in the second side of the first crossbar member when a spring is employed to move the finger element and is in a bottom wall of the first crossbar member when gravity is employed to move the finger element. The first crossbar member may be hollow and may have a substantially rectangular cross-sectional configuration. The topside of the first crossbar member may be substantially planar.

Five, the second crossbar member has a first end connected to the other side rail member. The second crossbar member may have a second end that may be received within the second open end of the first crossbar member so that the second crossbar member is telescopically mounted within the first crossbar member. This enables the first and second crossbar members to move lengthwise relative to each other. The teeth may be between the first and second ends of the second crossbar member. The second crossbar member may have a substantially U-shaped configuration and the teeth may be along an edge of one leg of the U-shaped second member.

Six, a manually actuated arm may be mounted to pivot on the second side of the first crossbar member near the opening. The arm may include a stop element adjacent the third side of the first crossbar member. The finger element may be connected to the arm to extend through the opening. The arm is manually actuated to move the finger element between the first and second positions. In the first position, the stop element is displaced outward from the third side of the first crossbar member. In the second position, the stop element is displaced inward towards the third side. The spring member may have one end fixedly attached to the first crossbar member and another end engaging the arm and biased to normally urge the arm to position the finger element in the first position. A portion of the perimeter of the arm may be curved. This curved portion lies opposite the finger element. The arm may have a pivoted end that lies between the third side and a fourth side of the first crossbar member when the arm moves the finger element between the first and second positions. These features are not listed in any rank order nor is this list intended to be exhaustive.

DESCRIPTION OF DRAWING

Some embodiments of this invention, illustrating all its features, will now be discussed in detail. These embodiments depict the novel and non-obvious bed base of this invention as shown in the accompanying drawing, which is for illustrative purposes only. This drawing includes the following figures (Figs.), with like numerals indicating like parts.

DETAILED DESCRIPTION OF SOME EMBODIMENTS OF THIS INVENTION

Figure 1:
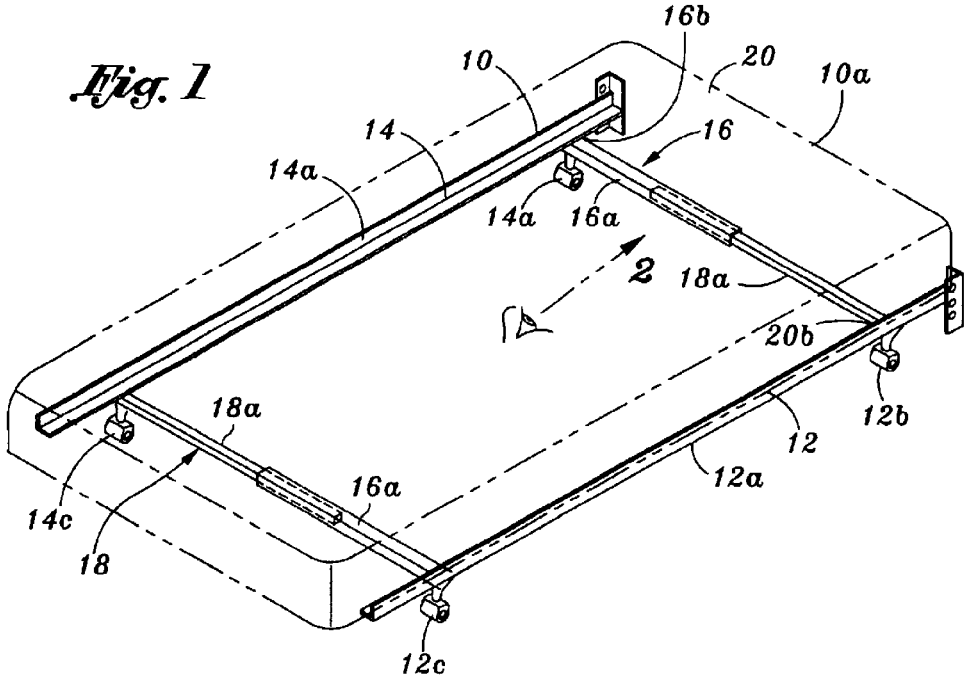
FIG. 1 is a perspective of the bed base according to one embodiment of this invention.
Figure 2:
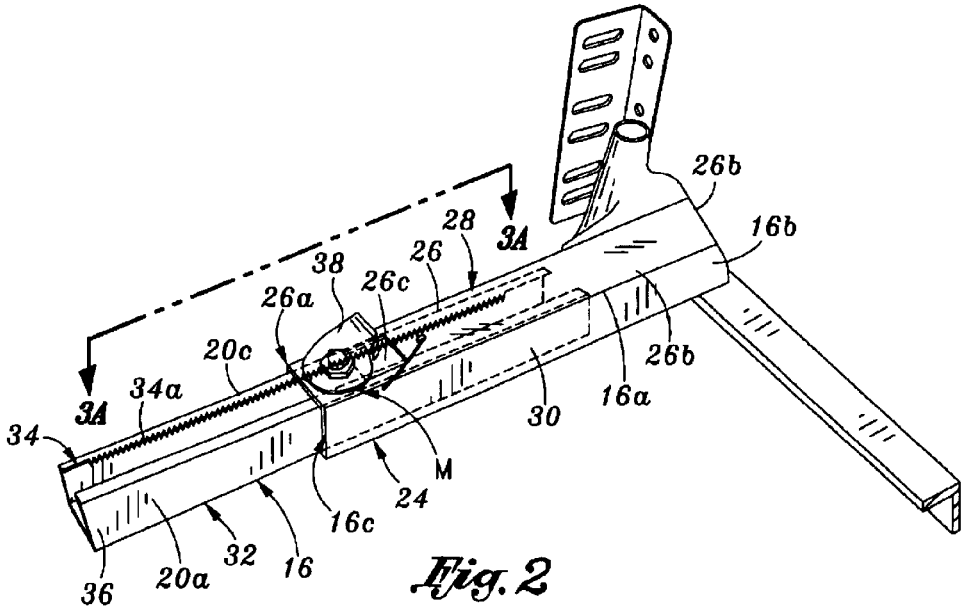
FIG. 2 is a fragmentary, perspective view of the bed base in FIG. 1 inverted to show its crossbar.

As shown in FIGS. 1 and 2, one embodiment of the bed base of this invention, the bed base 10, comprises a side rail 14 and a side rail 12 connected together by a pair of crossbars 16 and 18. A feature of the bed base 10 is that the width of the crossbars 16 and 18, i.e., the distance between the side rails 12, 14, may be adjusted to accommodate beds of different sizes. Each crossbar 16 and includes a ratchet mechanism to control the movement of the side rails 12, 14 relative to each other. The ratchet mechanism has a locked position that prevents the opposed side rail members from moving in an outward direction away from each other and an unlocked position that enables the opposed side rail members to move outward relative to each other, To achieve this each crossbar 16 and 18 has a locking and release crossbar mechanism M including a finger element 44 that locks the crossbars 16 and 18 into a selected position and is manually actuated so the length of the crossbars 16 and 18 may be increased or decreased.

The side rails 12 and 14 may each comprise elongated members having a substantially L-shaped cross-section. The side rails 12, 14 may lie opposed to and parallel to each other. Mounted on each side rail 12, 14 may be a pair of caster wheels 12*b*, 12*c* and 14*b*, 14*c*, respectively. As depicted in FIGS. 2, 3A, 3B and 4, the crossbars 16 and 18 are at an angle of about 90 degrees with respect to the side rails 12 and 14. Each crossbar 16 and 18 comprises a pair of elongated members, the female member 16*a* and the male member 18*a*. In the one embodiment shown in FIG. 1, the female member 16*a* of the crossbar 16 extends from the side rail 14 and the male member 18*a* of this crossbar 16 extends from the side rail 12, and the female member 16*a* of the crossbar 18 extends from the side rail 12 and the male member 18*a* of the crossbar 18 extends from the side rail 14. The female member 16*a* has an outer end 16*b* attached to the side rail 14, and the male member 18*a* has an outer end 20*b* attached to the side rail 12. These crossbars 16 and 18 may have their respective female and male member 16*a* and 18*a* connected to the side rails 12 and 14 so that both the male members extend from the side rail 12 or the side rail 14.

Figure 3A:
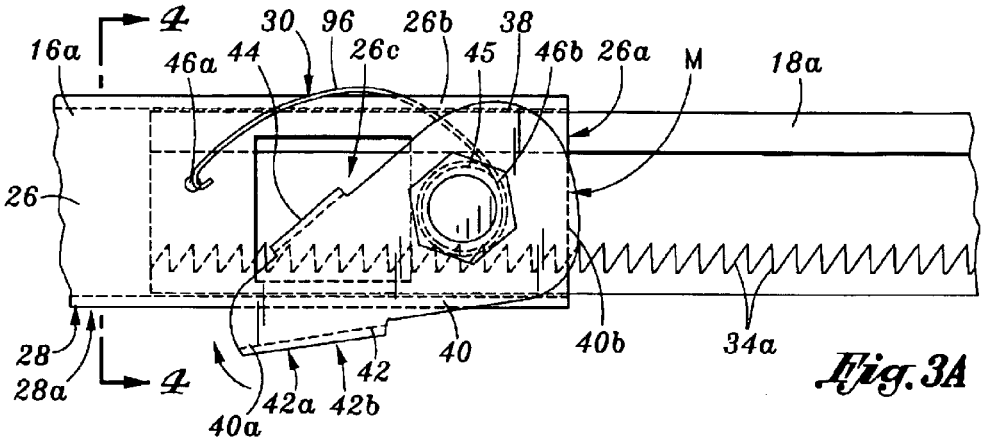
FIG. 3A is a plan view taken along line 3A—3A in FIG. 2 showing one crossbar of the bed base with a finger element in an engaged position.
Figure 3B:
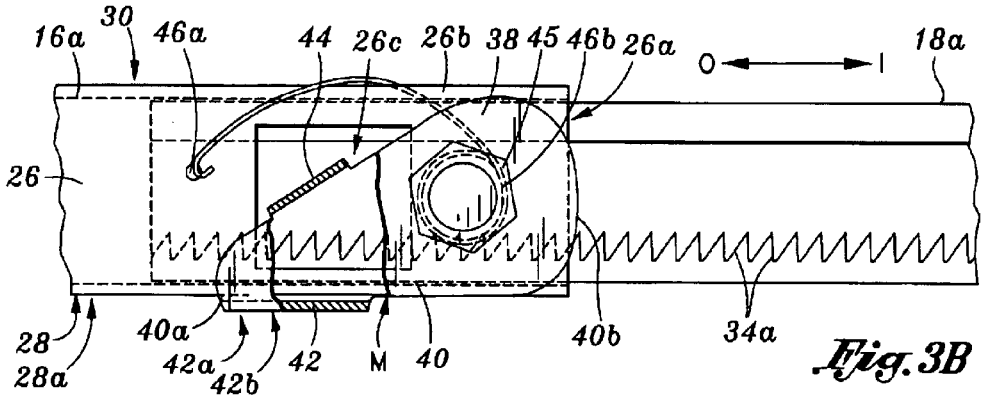
FIG. 3B is a plan view similar to that of FIG. 3A, with sections broken, showing the finger element in a disengaged position.
Figure 4:
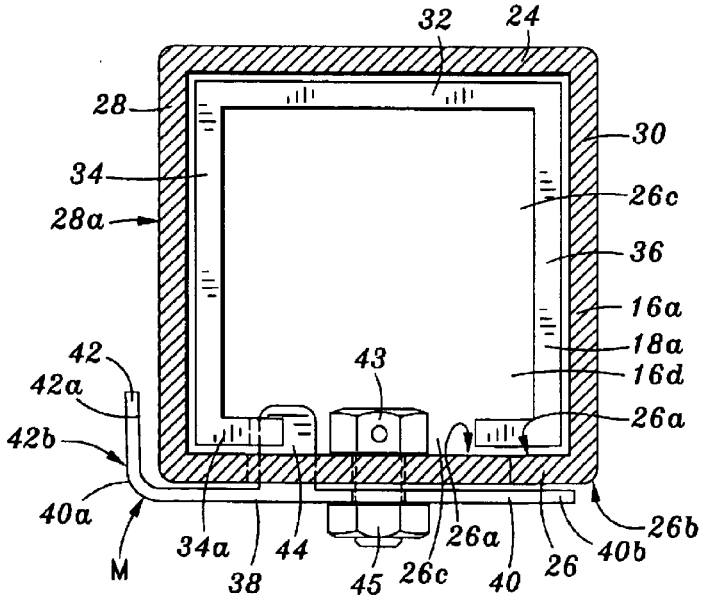
FIG. 4 is a cross-sectional view of the bed base taken along line 4—4 of FIG. 3A.

The female member 16*a* may have a rectangular cross-section, for example a square cross-section, which is a special case of a rectangle with all four sides of equal length. This female member 16*a* comprises a top wall 24, a bottom wall 26, a sidewall 28 having an outer surface 28*a*, a sidewall 30, and an open inner end 16*c*. The top wall 24 supports a box spring resting on it. The bottom wall 26 has an opening 26*c* therein and an inner surface 26*a* and an outer surface 26*b*. The opening 26*c* may be rectangular in shaped and may be located proximate to the inner end 16*c* of the female member 16*a*. The female member 16*a* typically has a hollow interior 16*d* that is larger than the cross-sectional area of the male member 18*a*, such that the male member may be inserted into the female member 16*a*. The male member 18*a* has its end 20*c* (FIG. 2) received within the open inner end 16*c* of female member 16*a* so that the male member is telescopically mounted within the female member, enabling the female and male members 16*a* and 18*a* to move lengthwise relative to each other. The male member 18*a* may have a substantially U-shaped cross-section with a top wall 32, a sidewall 34 having a bottom edge 34*a* and a sidewall 36. The sidewalls 34 and 36 may be parallel and the top wall 32 may be at a right angle to these sidewalls 34 and 36. A series of teeth 34*a* may be located along the bottom edge 34*a* of sidewall 34, and the teeth 34*a* may face inwards pointing towards the sidewall 36. In the embodiment shown in FIGS. 1 through 4, the locking and release crossbar mechanism M is mounted to the bottom wall 26 of female member 16*a*. This locking and release crossbar mechanism M includes a manually actuated arm 38 with a return spring member 46. The arm 38 may be pivotally mounted by a nut 45 and bolt 43 on the outer side 26*b* of the bottom wall 26 of female member 16*a* near the open inner end 16*c*. The arm 38 may be a bent sheet of metal including a platform 40 having a finger end 40*a* and a pivoted end 40*b*, a stop element 42, and a finger element 44. The stop element 42 may comprise a flat member 42*a* that extends perpendicular to the platform 40 towards top wall 24, and parallel to the outer side 28*a* of the sidewall 28. The finger element 44 may extend perpendicularly from the platform 40 through the opening 26*c*. The arm 38 may be rotated between an engaged position where the finger element 44 is disposed between the teeth 34*a* as shown in FIG. 3A, and a disengaged position where the finger element 44 is not disposed within the teeth 34*a* as shown in FIG. 3B. When the finger element 44 is engaged, the male member 20*a* cannot move longitudinally in an outward direction relative to female member 16*a*, thereby preventing the side rails 12 and 14 from moving outward relative to each other. Consequently, the side rails 12 and 14 will maintain a firm grasp of a mattress and/or box spring 10*a* seated between the side rails. Even with the finger element 44 engaged, the female member 16*a* may be moved inward towards the male member 20*a*, so that the side rails 12 and 14 may be pushed snugly against the mattress and/or box spring 10*a* seated therebetween. The pivoted end 40*b* may be curved so that it does not extend beyond sidewall 28 as the arm 38 is rotated. Thus, a user may hold female member 16*a* along the sidewall 28, and rotate arm 38 without the pivoted end 40*b* of the arm 38 pushing against his or her hand.

To adjust the length of the crossbars 16 and 18, a user, while holding a portion of a crossbar, disengages the finger element 44 to unlock the female and male member 16*a* and 18*a* by pressing the outer side 42*b* of the stop element 42 to cause the arm 38 to rotate in the clockwise direction to a release position as shown in FIG. 3B, disengaging the finger element 44 from the teeth 34*a*. The user may then move the side rails 12 and 14 either outwards O or inwards I as desired. The user locks the female and male members 16*a* and 18*a* together by releasing the arm 38. In this embodiment, the spring member 46 is used to urge the arm 38 to rotate such that the finger element 44 normally moves into the engaged position shown in FIG. 3A. The spring member 46 may have one end 46*a* fixedly attached to the first female member 16*a* and another end 46*b* wrapped about the nut and/or bolt 43, 45, to urge the arm 38 into the engaged position.

Figure 5:
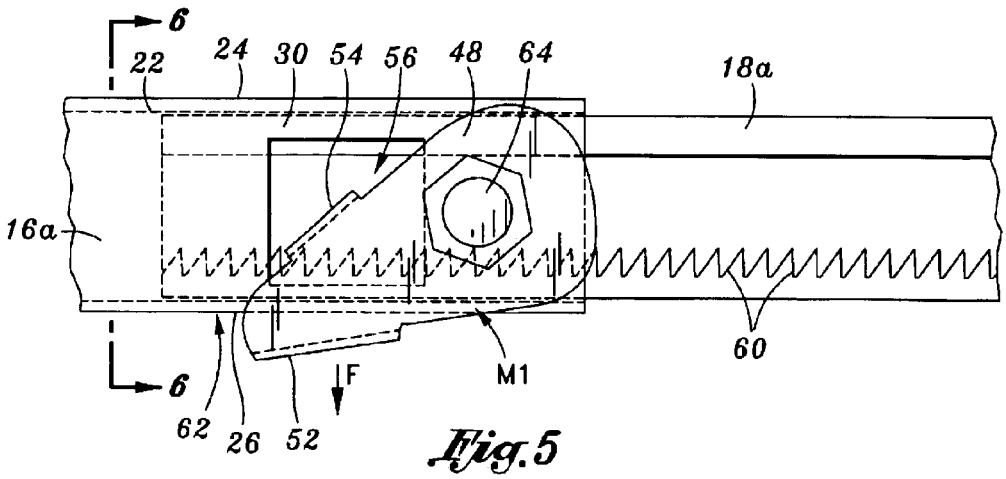
FIG. 5 is a plan view of the bed base according to one embodiment of this invention where the finger element moves due to gravity.
Figure 6:
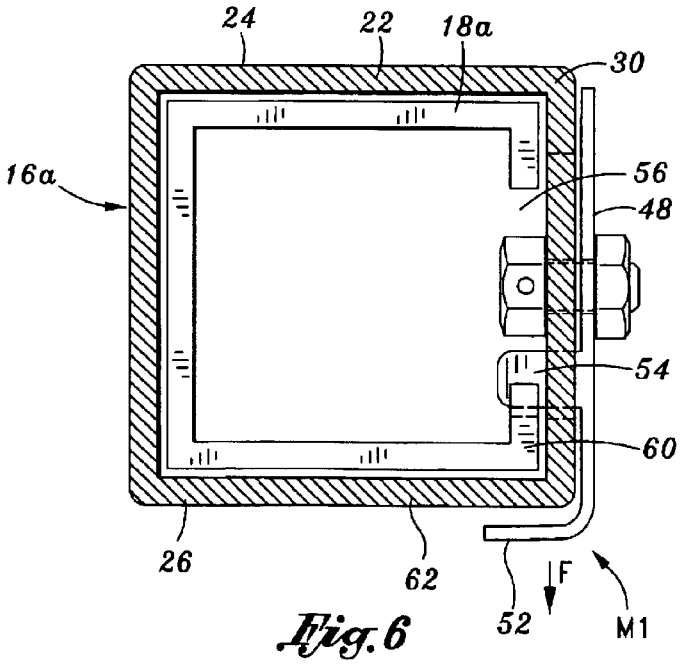
FIG. 6 is a cross-sectional view of the bed base in FIG. 5 taken along line 6—6.

In the embodiment shown in FIGS. 5 and 6, a locking and release crossbar mechanism M1 is mounted on the sidewall 30 of the female member 16*a* and this sidewall 30 has an opening 56 therein. The locking and release crossbar mechanism M1 does not use a spring return, but rather relies on gravity to move into the normally locked position. An arm 48 of the locking and release crossbar mechanism M1 is pivotally coupled to sidewall 30, with its finger element 54 disposed in the opening 56. The arm 48 may rotate between a first position where the finger element 54 engages the teeth 60 on the male member 18*a* and a second position where a stop member 52 is in contact with a bottom wall 62 of the female member 16*a*. As shown in FIG. 5, since the center of gravity of arm 48 lies to the left of the pivot point 64, gravitational forces F will act upon the arm 48 causing it to rotate counter-clockwise into an engaged position with finger element 54 lying between adjacent teeth 60. To disengage, a user simply presses against the arm 48 to rotate it clockwise as shown in FIG. 5.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

What is claimed is:

1. A bed base comprising a pair of opposed side rail members, and a crossbar connected between the side rail members, said crossbar including a first member and a second member connected together so that the first and second members move relative to each other, said second member having a plurality of teeth and said first member having a finger element moveable between a first position and a second position, said finger element in the first position engaging one of said teeth to prevent relative movement between the first and second members and in the second position disengaging from the teeth to enable relative movement between the first and second members, where the finger element is mounted to the first member to move into the first position due to gravity to engage the teeth and is manually moveable into the second position to disengage from the teeth.

2. A bed base comprising a first and second opposed parallel side rail members, one crossbar connected substantially at a right angle between said first and second side rail members, said crossbar including an elongated first member having a first end attached to the first side rail member and a second open end, a top side, a second side with an opening therein, and a third side, and an elongated second member having a first end connected to the second side rail member, a second end that is received within the second open end of the first member so that the second member is telescopically mounted within the first member enabling the first and second members to move lengthwise relative to each other, and a series teeth in a row side by side between the first and second ends of the second member, and a manually actuated arm mounted to pivot on the second side of the first member near the opening and including a stop element adjacent the third side of the first member and a finger element that extends through the opening, said arm moveable between a first position where said finger element engages one of said teeth to prevent movement between the first and second members and the stop element is displaced outward from said third side and a second position where said finger element disengages from the teeth to enable the first member to be manually move lengthwise within the second member and the stop element is displaced inward towards said third side.

3. The bed base according to claim 2 including a spring member having one end fixedly attached to the first member and another end engaging the arm and biased to normally urge the arm into the first position.

4. The bed base according to claim 2 here the finger element is mounted to the first member to move into the first position due to gravity to engage the teeth and is manually moveable into the second position to disengage from the teeth.

5. The bed base according to claim 2 where the teeth face inwardly.

6. The bed base according to claim 2 where the second member has a substantially U-shaped configuration and the teeth are along an edge of one leg of the U-shaped second member.

7. The bed base according to claim 2 where the first member is hollow and has a substantially rectangular cross-sectional configuration.

8. The bed base according to claim 2 where the topside is substantially planar.

9. The bed base according to claim 2 where a portion of the perimeter of said arm is curved.

10. The bed base according to claim 9 where said curved portion lies opposite said finger element.

11. The bed base according to claim 2 where a pivoted end of said arm lies between said third side and a fourth side when said arm is moved between said first position and said second position.

12. The bed base of claim 2 further comprising a second crossbar member connected between the first and second side rail members and spaced from and parallel to the one crossbar member.

13. The bed base of claim 12 where the second crossbar member comprises an elongated third member having a first end attached to the second side rail member and a second open end, and a fourth member having a first end connected to the first side rail member, a second end that is received within the second open end of the third member so that the third member is telescopically mounted within the fourth member enabling the third and fourth members to move lengthwise relative to each other, and a series of teeth in a row side by side between the first and second ends of the fourth member.

14. The bed base of claim 2 where said second side with an opening therein is a bottom wall of said first elongated member.

15. The bed base of claim 2 where said second side with an opening therein is a sidewall of said first elongated member.

16. A bed base comprising a first and second opposed parallel side rail members, a pair of crossbars each connected substantially at a right angle between said first and second side rail members, each said crossbar including an elongated first member having a first end attached to the first side rail member, a second open end, and a side with an opening therein, and a second member having a first end connected to the second side rail member, a second end that is received within the second open end of the first member so that the second member is telescopically mounted within the first member enabling the first and second members to move lengthwise relative to each other, and a series teeth in a row side by side between the first and second ends of the second member, and a manually actuated arm mounted on the first member and including a finger element that extends through the opening, said arm moveable between a first position where said finger element engages one of said teeth to prevent movement between the first and second members and a second position where said finger element disengages from the teeth to enable the first member to be manually moved lengthwise within the second member, where the arm includes a stop element that is displaced outward from a side of the second member when the arm is moved from the first position to the second position and engages said side when in the second position.

17. A bed base comprising a first and second opposed parallel side rail members, a pair of crossbars each connected substantially at a right angle between said first and second side rail members, each said crossbar including an elongated first member having a first end attached to the first side rail member, a second open end, and a side with an opening therein, and a second member having a first end connected to the second side rail member, a second end that is received within the second open end of the first member so that the second member is telescopically mounted within the first member enabling the first and second members to move lengthwise relative to each other, and a series teeth in a row side by side between the first and second ends of the second member, and a manually actuated arm mounted on the first member and including a finger element that extends through the opening, said arm moveable between a first position where said finger element engages one of said teeth to prevent movement between the first and second members and a second position where said finger element disengages from the teeth to enable the first member to be manually moved lengthwise within the second member, where the finger element is mounted to the first member to move into the first position due to gravity to engage the teeth and is manually moveable into the second position to disengage from the teeth.

18. A bed base comprising a pair of opposed side rail members, and a crossbar connected between the side rail members, said crossbar including a pair of members connected together so that the to move relative to each other, and said pair of members having a ratchet mechanism with a locked position that prevents the opposed side rail members from moving in an outward direction away from each other and an unlocked position that enables the opposed side rail members to move outward relative to each other, said ratchet mechanism including a finger element mounted to the first member to move into a locked position due to gravity to engage the teeth and being manually moveable into an unlocked position to disengage from the teeth.

19. A bed base comprising a crossbar connected between a pair of opposed side rail members, said crossbar including a ratchet mechanism that prevents the opposed side rail members from moving in an outward direction away from each other when engaged, said ratchet mechanism including a locking and release member normally in a locked position due to gravity.

* * * * *